US011608255B2

(12) United States Patent
Turnbull et al.

(10) Patent No.: US 11,608,255 B2
(45) Date of Patent: Mar. 21, 2023

(54) TRUCK MOUNTED FORKLIFT

(71) Applicant: CARGOTEC RESEARCH & DEVELOPMENT IRELAND LIMITED, Dundalk (IE)

(72) Inventors: Kevin Turnbull, Dundalk (IE); Sarah Grogan, Swords (IE)

(73) Assignee: CARGOTEC RESEARCH & DEVELOPMENT IRELAND LIMITED, Dundalk (IE)

( * ) Notice: Subject to any disclaimer, the term of this patent is extended or adjusted under 35 U.S.C. 154(b) by 67 days.

(21) Appl. No.: 17/262,593

(22) PCT Filed: Jul. 24, 2019

(86) PCT No.: PCT/EP2019/069967

§ 371 (c)(1),
(2) Date: Jan. 22, 2021

(87) PCT Pub. No.: WO2020/020971

PCT Pub. Date: Jan. 30, 2020

(65) Prior Publication Data

US 2021/0354963 A1 Nov. 18, 2021

(30) Foreign Application Priority Data

Jul. 24, 2018 (GB) ..... 1812045

(51) Int. Cl.
*B66F 9/065* (2006.01)
*B66F 9/075* (2006.01)
*B66F 9/12* (2006.01)

(52) U.S. Cl.
CPC ..... *B66F 9/0655* (2013.01); *B66F 9/07563* (2013.01); *B66F 9/122* (2013.01)

(58) Field of Classification Search
CPC ..... B66F 9/065; B66F 9/0655; B66F 9/122; B66F 9/07563; B60P 3/07
See application file for complete search history.

(56) References Cited

U.S. PATENT DOCUMENTS 3,834,569 A * 9/1974 Holtkamp ..... B66F 9/065 414/707
4,215,971 A * 8/1980 Itey-Bernard ..... B66F 9/065 414/696

(Continued)

FOREIGN PATENT DOCUMENTS

EP 1531141 A1 * 5/2005 ..... B66F 9/065
FR 2520715 A1 * 2/1982 ..... B66F 9/0655

(Continued)

*Primary Examiner* — Kaitlin S Joerger
(74) *Attorney, Agent, or Firm* — Brian J. Colandreo; Jeffery T. Placker; Holland & Knight LLP

(57) ABSTRACT

Truck mounted forklift (200) for mounting on the rear of a vehicle. The truck mounted forklift comprises a u-shaped chassis (201) with a linkage (103) lifting assembly mounted thereon. The linkage lifting assembly comprises a carriage (101) slidably mounted on the chassis and a linkage, the linkage comprising a first link (105) connected to the carriage by a pivot joint (107) and a second link (109) connected to the first link by a pivot joint (111). A fork carriage (113) is connected to the other end of the second link. The second link comprises a telescopic link having a plurality of link sections nested together. Cylinders (115, 117) are provided to operate the links and the telescopic link. The linkage is more compact than other duplex (i.e. two part) linkages, will not protrude rearwardly increasing the overhang of the forklift and will be able to be mounted and dismounted in a substantially vertical direction, obviating the need for reinforced, heavier tines.

12 Claims, 7 Drawing Sheets

(56) References Cited

U.S. PATENT DOCUMENTS

| | | | | |
|---|---|---|---|---|
| 6,705,826 | B1 * | 3/2004 | Callens | B66F 9/065 414/700 |
| 7,001,131 | B2 * | 2/2006 | O'Keeffe | B66F 9/07563 414/661 |
| 2004/0179925 | A1 * | 9/2004 | O'Keeffe | B66F 9/07563 414/467 |
| 2007/0166141 | A1 * | 7/2007 | McGrane | B66F 9/07563 414/558 |
| 2018/0319639 | A1 * | 11/2018 | Turnbull | B66F 9/065 |

FOREIGN PATENT DOCUMENTS

| | | | | |
|---|---|---|---|---|
| FR | 2528027 | A2 * | 6/1982 | B66F 9/0655 |
| GB | 2543317 | A * | 4/2017 | B66F 9/065 |
| GB | 2575825 | A * | 1/2020 | B66F 9/065 |

* cited by examiner

TRUCK MOUNTED FORKLIFT

RELATED APPLICATIONS

The subject application is a U.S. National Stage application of International Application No. PCT/EP2019/069967, which claims the priority of GB Application No.: 1812045.1, filed on 24 Jul. 2018, the contents of which are herein incorporated by reference in its entirety.

TECHNICAL FIELD

This invention relates to a truck mounted forklift. More specifically, this invention relates to a truck mounted forklift with an alternative linkage lifting assembly.

BACKGROUND ART

Truck mounted forklifts are a highly specialised type of lightweight forklift truck that can be mounted on the rear of a truck or trailer for transport to and from customer's premises. Once at the customer's premises, the truck mounted forklift can be dismounted from the rear of the truck and used to load and unload goods from the truck or trailer before being remounted onto the rear of the truck or trailer for transport to the next customer's premises.

Out of necessity, the truck mounted forklifts must be lightweight as any increase in truck mounted forklift weight will correspond to a decrease in available haulage capacity of the truck or trailer about which it is mounted. Furthermore, the truck mounted forklifts must be compact in a fore and aft sense as the amount by which the truck mounted forklift may protrude from the rear of the carrying vehicle (commonly referred to as "overhang") is restricted by law in many jurisdictions. Furthermore, the greater the overhang, the greater the forces applied to the mounting. Increased forces necessitate reinforcement of these components which typically leads to increased weight which as described before is highly undesirable. An example of one such truck mounted forklift is that disclosed in the Applicant's own granted European Patent No. EP1711428. The present invention is concerned solely with this type of specialised lightweight forklift truck and is to be considered in light of the limitations of truck mounted forklifts. The present invention is in no way intended to relate to other types of forklift trucks such as the commonplace heavyweight counterbalanced forklift trucks that are not so restricted and do not require the same design considerations.

Heretofore, some of the most common lifting assembly configurations used in truck mounted forklifts have been moving mast, static mast and telescopic boom configurations. The moving mast and static mast implementations typically comprise an upright mast with a pantograph linkage or other mechanism to increase the reach of the forks carried on the mast. While each of these configurations has advantages, each also has a distinct problem with loading and unloading the top far side of a container or trailer. Due to the height of the pantograph arrangement, moving masts with pantograph sections cannot reach under the top of containers or trailers. Static mast machines can only reach the far side of a trailer if they can drive the front wheels under the truck or trailer which is not always possible. Furthermore, static mast machines equipped with a pantograph arrangement may also be prevented from reaching under the top of the trailer or container. Telescopic booms are obstructed by bottom near side loads when reaching top far side loads and the bottom near side loads must be moved prior to the top far side loads being accessed. In addition to the inconvenience, this can also make the trailer unstable as all the loads are on one side.

One useful type of truck mounted forklift is that disclosed in the Applicant's own granted European Patent No. EP1,531,141. Although EP1,531,141 provides a useful alternative for the consumer, there are however problems with the design of forklift described therein in that the lifting assembly of the forklift is relatively heavy and bulky. This decreases the load capacity of the carrying vehicle. Furthermore, the weight distribution of the lifting assembly of EP1,531,141 on the forklift is sub-optimal as the weight is relatively far forward on the forklift. This affects the maneuverability of the forklift and limits the lifting capacity of the forklift itself. In addition, the driver's visibility is somewhat impaired by the lifting assembly.

One proposed solution to the problems encountered with the known arrangements of lifting assemblies is a so-called linkage lifting assembly, as described in the applicants own published PCT patent application publication no. WO2017/064313 entitled "A truck mounted forklift". The linkage lifting assemblies described therein, particularly the triplex linkage lift assembly, overcame many of the problems with the known arrangements of lifting assemblies however there are some problems with the duplex linkage lifting assembly having only two links described therein.

First of all and perhaps most importantly, when the truck mounted forklift with the duplex linkage lifting assembly was mounted on the carrying vehicle (as illustrated in FIG. 27 of WO2017/064313), the links protruded rearwardly from the carrying vehicle, increasing the overhang of the forklift truck substantially. As indicated above, this is highly undesirable. Secondly, the links would protrude rearwardly of the forklift in various modes of operation (see for example FIG. 22 of WO2017/064313) which is undesirable from a health and safety point of view as well as preventing the forklift from operating in tight spaces. Thirdly, when picking up a load between the side bars, the links would protrude upwardly of the uppermost point of the forklift (see for example FIG. 25 of WO2017/064313) which is undesirable if the forklift is to be operated in areas of low clearance such as on the bed of a roofed trailer. The links could obstruct the forklift attempting to pick up a load. Finally, with the duplex linkage lifting assembly, the forklift follows a substantially arcuate path when being mounted or dismounted onto a vehicle. This arcuate path places a significant load onto the forks, requiring reinforcement of the forks resulting in increased weight, which is highly undesirable as outlined above.

It is an object therefore of the present invention to provide a truck mounted forklift that overcomes at least some of the above-mentioned problems and that provides a useful choice for the consumer.

SUMMARY OF INVENTION

According to the invention there is provided a truck mounted forklift for mounting on the rear of a vehicle, the truck mounted forklift comprising a u-shaped chassis having a pair of forwardly projecting side bars bridged by a rear crossbar, a wheel adjacent the forwardmost end of each of the side bars and a rear wheel mounted on the rear cross bar, a driver's station mounted to one side of the chassis, a motive power unit mounted on the other side of the chassis and a linkage lifting assembly mounted on the chassis, the linkage lifting assembly comprising:

a carriage slidably mountable on the chassis, the carriage being slidable towards and away from the rear crossbar and means to move the carriage back and forth along the chassis; and a linkage, the linkage comprising:

an upright elongate first link connected at its proximal end to the carriage by a pivot joint;

an elongate second link connected at its proximal end to the distal end of the first link by a pivot joint, the elongate second link comprising a telescopic link having a plurality of link sections nested together;

a fork carriage connected to the distal end of the second link by a pivot joint;

a plurality of link cylinders for actuating the links;

a telescoping cylinder for lengthening and shortening the telescopic second link; and a tilt cylinder for actuating the fork carriage.

By having such a truck mounted forklift, the forklift overcomes the problems of the known moving mast, static mast and telescopic boom configurations with loading and unloading the top far side of a container or trailer. Advantageously, by providing the linkage on a carriage and a telescopic link as the second link, the linkage lifting assembly can have sufficient reach to access far side loads but also be sufficiently compact that it will not protrude rearwardly of the forklift, increasing the overhang of the forklift when the forklift is mounted on a carrying vehicle, or when the forklift is in use moving a load.

Furthermore, by providing a telescopic link as the second link, the height of the forklift will not be increased to an extent that it would prevent operation of the forklift in areas of low clearance. Importantly, the telescopic link will permit the duplex linkage lifting assembly to be mounted and dismounted onto a carrying vehicle by operating the telescopic link to move the forklift in a substantially vertical direction rather than along an arcuate path. This will facilitate mounting and dismounting of the forklift and will obviate the need to reinforce the tines or other equipment and increase the weight of the forklift.

In addition to the foregoing, there is a key advantage of the embodiment shown over a fixed boom assembly or the assembly shown in WO2017/064313 in that the configuration of lifting assembly described has a much-improved weight distribution, due to the mechanism being mounted on a moving carriage. Alternative boom designs known in the art carry much of their weight to the rear of the forklift, making the forklift unstable, particularly when travelling unladen.

The embodiment of the invention also overcomes many of the limitations of lifting assemblies such as those described in EP1,531,141. The embodiment according to the invention is lighter that the lifting assembly of EP1,531,141 and will not impede the visibility of the driver to the same extent as the lifting assembly of EP1,531,141. Importantly, due to the fact that the pivot between the first link and second link is positioned further rearwardly on the forklift when compared to the lifting assembly of EP1,531,141, the configuration according to the invention will have improved weight distribution when lifting and improved lifting capacity.

In one embodiment of the invention there is provided a truck mounted forklift in which the elongate second link is cranked intermediate its ends into a substantially L-shaped member such that with the linkage lifting assembly in a retracted configuration, the spine of the L-shaped member is directed substantially vertically and the arm of the L-shaped member is directed rearwardly from the uppermost part of the spine, and with the linkage lifting assembly in an extended configuration, the spine of the L-shaped member is directed forwardly and the arm of the L-shaped member is directed substantially vertically downwards from the rearwardmost part of the spine. This is seen as a particularly advantageous configuration of second link in that the link will be able to more easily clear near side loads. This will also enable a more compact mast to be provided. Furthermore, due to the L-shaped configuration, the lifting assembly will have better lift height relative to it's collapsed height when compared to lifting assemblies such as those described in EP1,531,141.

In one embodiment of the invention there is provided a truck mounted forklift in which the elongate second link is cranked intermediate its ends into a substantially L-shaped member such that the arm and the spine of the L-shaped members are substantially orthogonal with respect to each other. This is seen as particularly useful as this will provide greater height to the distal end of the second link as it pivots about the pivot point and will enable the first mast section to be more compact than would otherwise be the case.

In one embodiment of the invention there is provided a truck mounted forklift in which the elongate first link is cranked intermediate its ends into a substantially upside-down L-shaped member such that the spine of the L-shaped member is directed substantially vertically and the arm of the L-shaped member is directed rearwardly from the uppermost part of the spine.

In one embodiment of the invention there is provided a truck mounted forklift in which the main link cylinder is connected at one of its ends to the second link and at the other of its ends to the carriage. It is envisaged that the main lift cylinder may be provided by a pair of lift cylinders.

In one embodiment of the invention there is provided a truck mounted forklift in which the main link cylinder is connected at one of its ends to the second link and at the other of its ends to the first link. Again, it is envisaged that the main lift cylinder may be provided by a pair of lift cylinders.

In one embodiment of the invention there is provided a truck mounted forklift in which the secondary link cylinder is connected at one its ends to the first link and at the other of its ends to the carriage.

In one embodiment of the invention there is provided a truck mounted forklift in which the first link is raked backwards from the vertical. By raking the first link backwards, the clearance for the cylinder will be facilitated.

In one embodiment of the invention there is provided a truck mounted forklift in which the first link is raked backwards at an angle of the order of 5 to 15 degrees from the vertical.

In one embodiment of the invention there is provided a truck mounted forklift in which the telescoping cylinder is located internal the second link.

In one embodiment of the invention there is provided a truck mounted forklift in which the telescoping cylinder is located external the second link.

In one embodiment of the invention there is provided a truck mounted forklift in which the tilt mechanism cylinder is located internal the second link.

BRIEF DESCRIPTION OF THE DRAWINGS

The invention will now be more clearly understood from the following description of some embodiments thereof given by way of example only with reference to the accompanying drawings, in which.

DETAILED DESCRIPTION OF THE DRAWINGS

Figure 1:
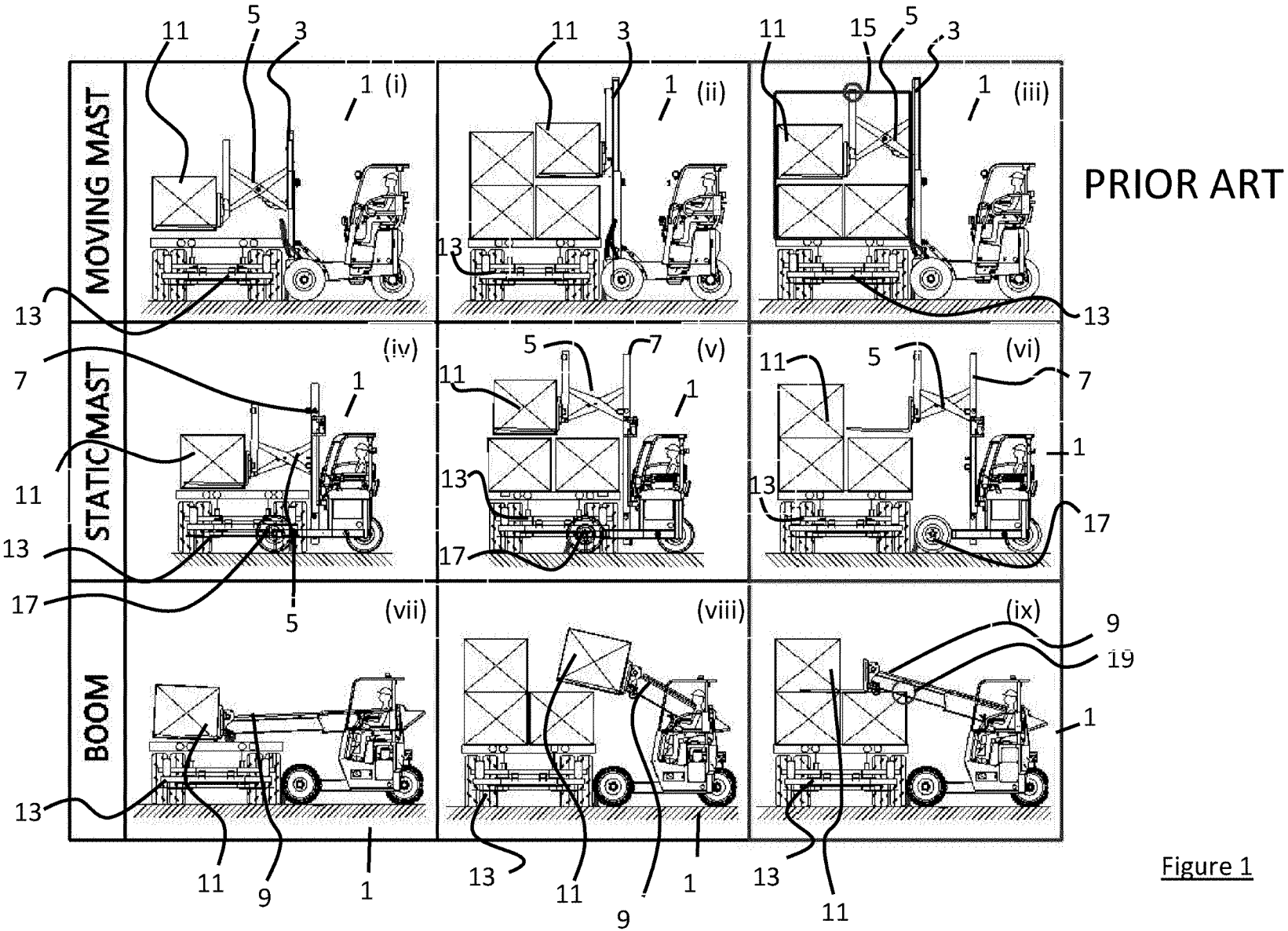
FIGS. 1(*i*) to (*ix*) illustrate truck mounted forklifts with lifting assemblies known in the art.

Referring to FIGS. 1(*i*) to 1(*ix*) inclusive, there are shown views of truck mounted forklifts with known lifting assemblies. FIGS. 1(*i*) to 1(*iii*) illustrate a truck mounted forklift 1 with a movable mast 3 having a pantograph linkage 5. FIGS. 1(*iv*) to 1(*vi*) illustrate a truck mounted forklift 1 with a static mast 7 having a pantograph linkage 5. FIGS. 1(*vii*) to 1(*ix*) illustrate a truck mounted forklift with a telescopic boom 9.

Referring specifically to FIGS. 1(*i*) to 1(*iii*), the truck mounted forklift with a movable mast is illustrated engaging a load 11 in a variety of positions on a carrying vehicle 13. In FIG. 1(*i*) the truck mounted forklift 1 is shown engaging a load 11 located in the bottom far side position of the carrying vehicle. The movable mast 3 is positioned forwards on the forklift 1 and the pantograph linkage 5 is fully extended. In FIG. 1(*ii*) the truck mounted forklift 1 is shown engaging a load 11 located in the top near side position of the carrying vehicle. It can be seen that there are no impediments to the lifting assembly engaging loads in these positions. In FIG. 1(*iii*) the truck mounted forklift 1 is shown attempting to engage a load in the top far side position on the carrying vehicle. It can be seen that the pantograph linkage comes into contact with the underside of the roof 15 of the carrying vehicle 13. Accordingly, this lifting assembly is unable to engage loads in the top far side position on the carrying vehicle.

Referring specifically to FIGS. 1(*iv*) to 1(*vi*), the truck mounted forklift with a static mast is illustrated engaging a load 11 in a variety of positions on a carrying vehicle 13. In FIG. 1(*iv*) the truck mounted forklift 1 is shown engaging a load 11 located in the bottom far side position of the carrying vehicle. The front wheels 17 of the truck mounted forklift 1 are positioned under the carrying vehicle 13. The static mast 7 is in position on the forklift 1 and the pantograph linkage 5 is fully extended. In FIG. 1(*v*) the truck mounted forklift 1 is shown engaging a load 11 located in the top far side position of the carrying vehicle 13. Again, the front wheels 17 are positioned under the carrying vehicle. It can be seen that the static mast 7 and the pantograph linkage 5 extend significantly upwards of the load 11 and may be obstructed by the roof of the trailer (not shown). In FIG. 1(*vi*) the truck mounted forklift 1 is shown attempting to engage a load in the top far side position on the carrying vehicle. It can be seen that the front wheels 17 are not positioned under the carrying vehicle 13. It is not uncommon for the wheels of the carrying vehicle to impede the progression of the front wheels 17 of the forklift under the carrying vehicle 13. Accordingly, in those circumstances, this lifting assembly is unable to engage loads in the top far side position on the carrying vehicle.

Referring specifically to FIGS. 1(*vii*) to 1(*ix*), the truck mounted forklift with a telescopic boom is illustrated engaging a load 11 in a variety of positions on a carrying vehicle 13. In FIG. 1(*vii*) the truck mounted forklift 1 is shown engaging a load 11 located in the bottom far side position of the carrying vehicle. The telescopic boom 9 is positioned forwards on the forklift 1 and is fully extended. In FIG. 1(*viii*) the truck mounted forklift 1 is shown engaging a load 11 located in the top near side position of the carrying vehicle. It can be seen that there are no impediments to the lifting assembly engaging the load 11 in these positions. In FIG. 1(*ix*) the truck mounted forklift is shown attempting to engage a load in the top far side position on the carrying vehicle. It can be seen that the telescopic boom comes into contact with the bottom near side load on the carrying vehicle 13 at the point indicated by circle 19. Accordingly, this lifting assembly is often unable to engage loads in the top far side position on the carrying vehicle. In order to overcome this obstruction, the bottom nearside position would have to be unloaded and reloaded, thus increasing the time taken to unload the top far side position and potentially making the trailer unstable.

Figure 2:
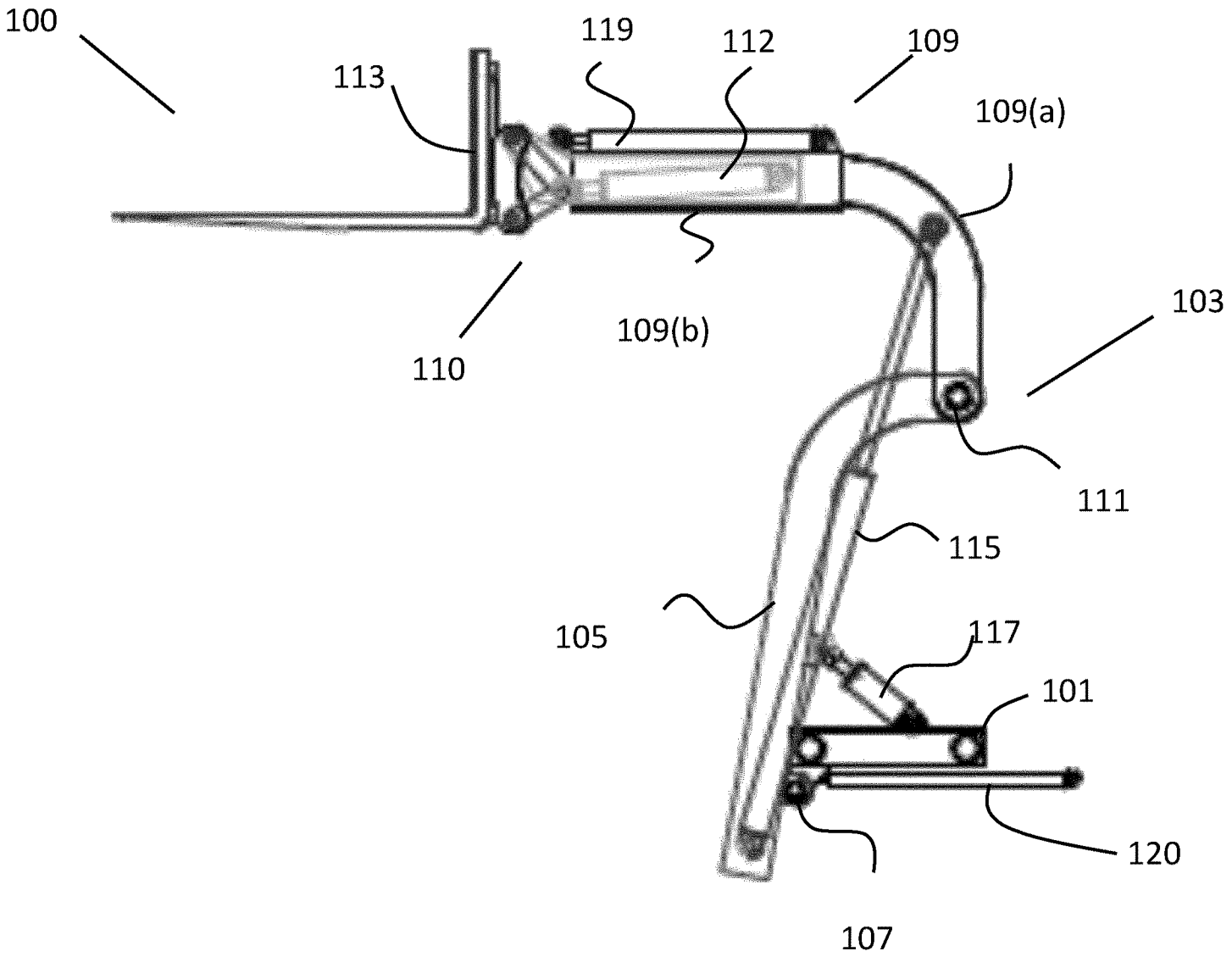
FIG. 2 is a lifting assembly for a truck mounted forklift according to the invention in a raised configuration.
Figure 3:
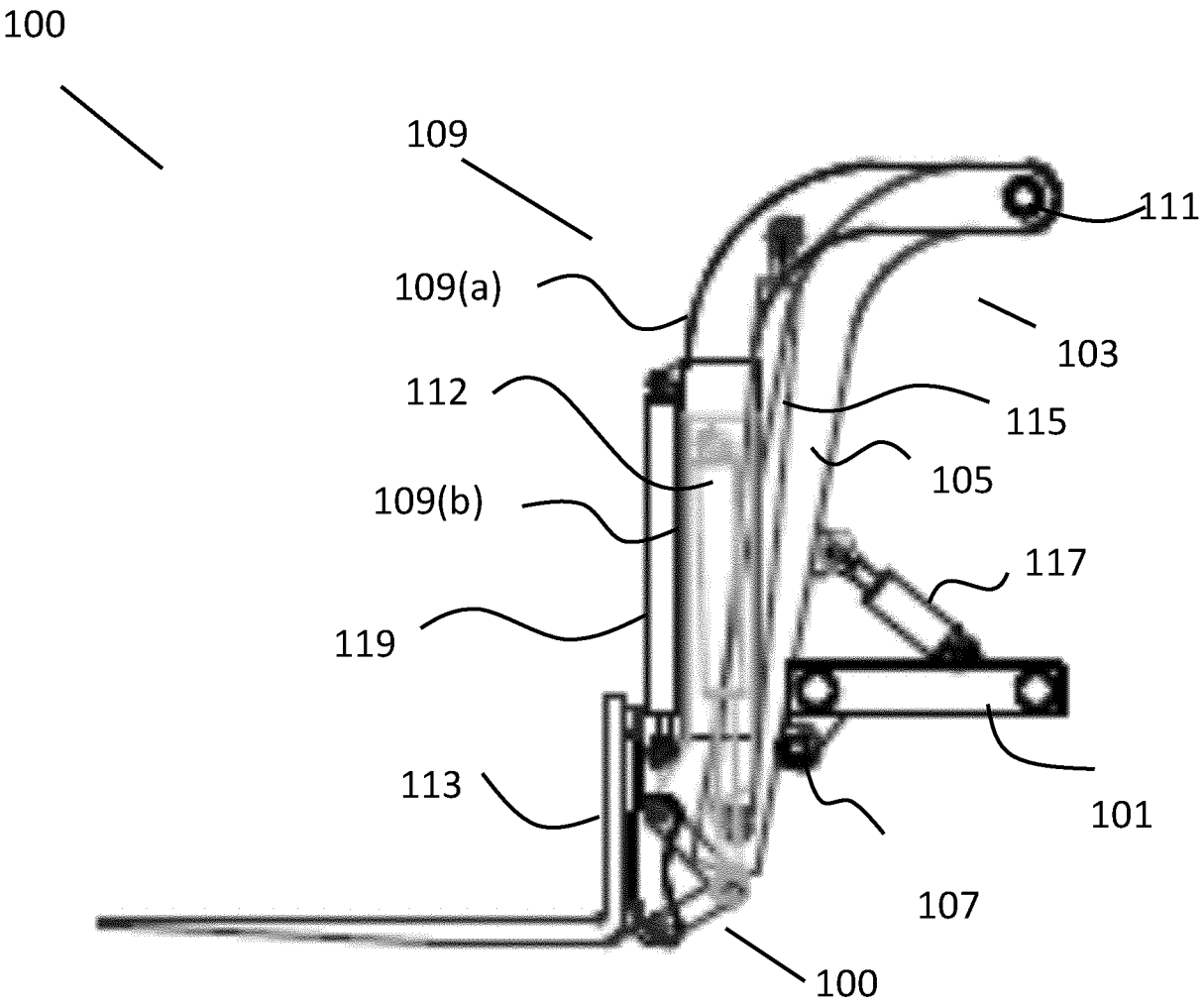
FIG. 3 is a lifting assembly for a truck mounted forklift according to the invention in a lowered configuration.

Referring now to FIGS. 2 and 3, there is shown a linkage lifting assembly for a forklift truck, indicated generally by the reference numeral 100. The linkage lifting assembly 100 comprises a carriage 101 slidably mountable on a chassis of a forklift (not shown), and a linkage 103. The linkage 103 comprises an upright elongate first link 105 connected at its proximal end to the carriage by a pivot joint 107 and an elongate second link 109 connected at its proximal end to the distal end of the first link by a pivot joint 111. The elongate second link 109 comprises a telescopic link having a plurality of link sections 109(*a*), 109(*b*) nested together. The elongate first link 105 is a fixed-length link.

A fork carriage 113 is connected to the distal end of the second link 109 by a pivot joint, in this case provided by a tilt mechanism 110 actuated by a tilt mechanism cylinder 112. There are further provided a plurality of link cylinders 115, 117 for actuating the links 109, 105 respectively, a telescoping cylinder 119 for lengthening and shortening the telescopic second link 109 and the tilt mechanism cylinder 112 for actuating the fork carriage about the pivot joint connecting the fork carriage to the distal end of the second link 109. In FIG. 2, there is shown a carriage cylinder 120 for moving the carriage forwards and backwards along the forklift chassis.

The elongate first link 105 and the elongate second link 109 are substantially L-shaped. The elongate first link 105 is cranked intermediate its ends into a substantially upside-down L-shaped member such that the spine of the L-shaped member is directed substantially vertically, and the arm of the L-shaped member is directed rearwardly from the uppermost part of the spine. In addition, the elongate second link 109 is also cranked intermediate its ends into a substantially L-shaped member such that with the linkage lifting assembly 100 in a retracted configuration as shown in FIG. 3, the spine of the L-shaped member is directed substantially vertically and the arm of the L-shaped member is directed rearwardly from the uppermost part of the spine, and with the linkage lifting assembly in an extended configuration as shown in FIG. 2, the spine of the L-shaped member is directed forwardly and the arm of the L-shaped member is directed substantially vertically downwards from the rearwardmost part of the spine.

Figure 5:
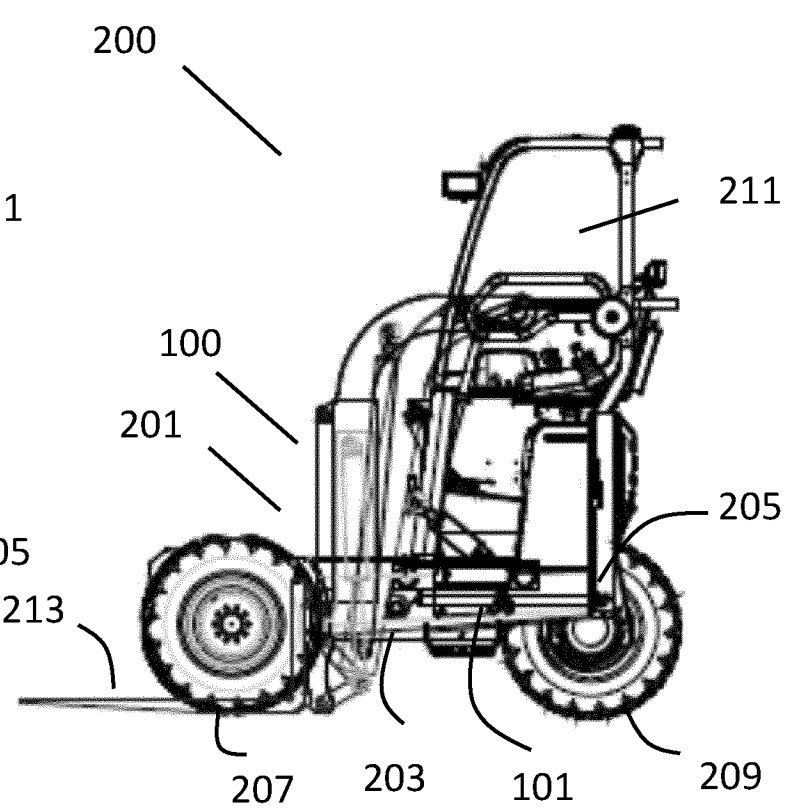
FIGS. 4 to 7 inclusive are side views of a truck mounted forklift according to the invention in a variety of load positions.
Figure 4:
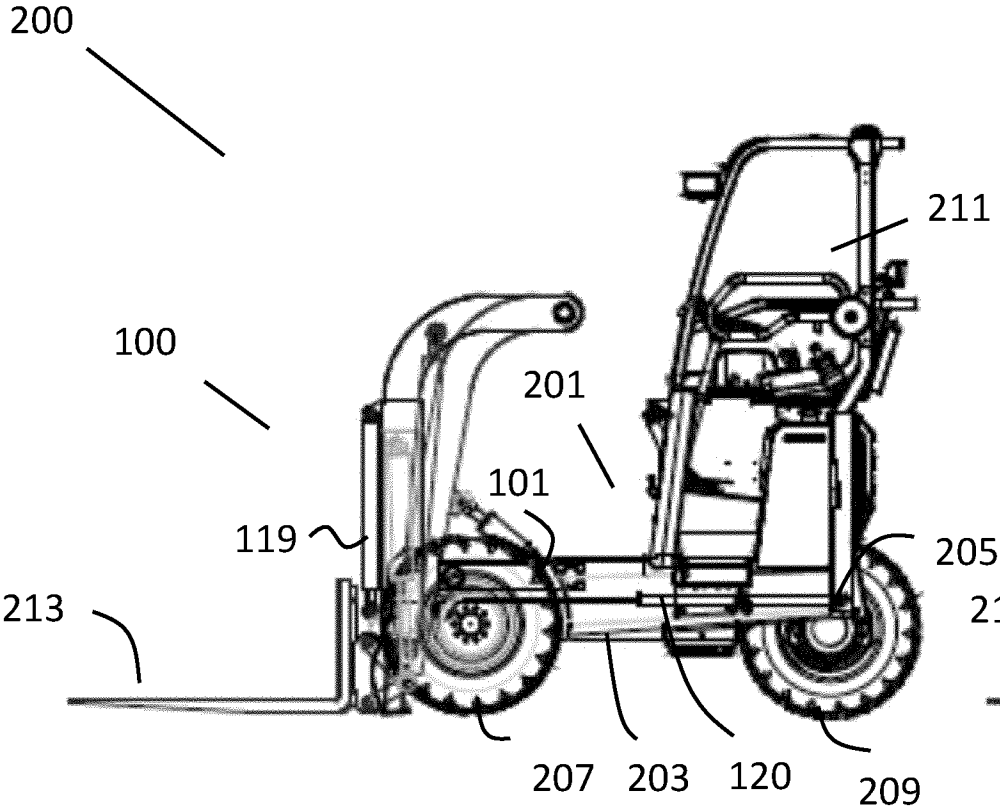

Referring to FIGS. 4 and 5, there are shown views of a truck mounted forklift, indicated generally by the reference numeral 200, having the linkage lifting assembly 100 mounted thereon. The truck mounted forklift 200 is configured for mounting on the rear of a carrying vehicle and comprises a u-shaped chassis 201 having a pair of forwardly projecting side bars 203 bridged by a rear crossbar 205. There is provided a wheel 207 adjacent the forwardmost end of each of the side bars 203 and a rear wheel 209 mounted on the rear cross bar 205. There is further provided a driver's station 211 mounted to one side of the chassis and a motive power unit (not shown) mounted on the other side of the chassis. The carriage 101 of the lifting assembly is slidably mounted on the side bars 203 of the chassis and is slidable towards and away from the rear crossbar 205. There is provided means (not shown) to move the carriage back and forth along the chassis. In order to slidably mount the carriage on the side bars, the carriage is provided with rollers and the side bars are provided with complementary tracks for reception of the rollers. Referring specifically to FIG. 4, the carriage is shown in its forwardmost position on the chassis with the tines 213 forward of the front wheels 207. Referring specifically to FIG. 5, the carriage 101 is shown in its rearwardmost position on the chassis with the fork carriage rearward of the front wheels 207.

In both FIGS. 4 and 5, the tines are shown in a lowered position where they may pick up or drop off a load on the ground. It can be seen that the second link, the telescopic link, is practically vertical. It will be understood that with the second link in this position, operation of the telescopic ram will cause vertical movement of the fork carriage and the tines. This is particularly advantageous for mounting and dismounting the truck mounted forklift.

Figure 6:
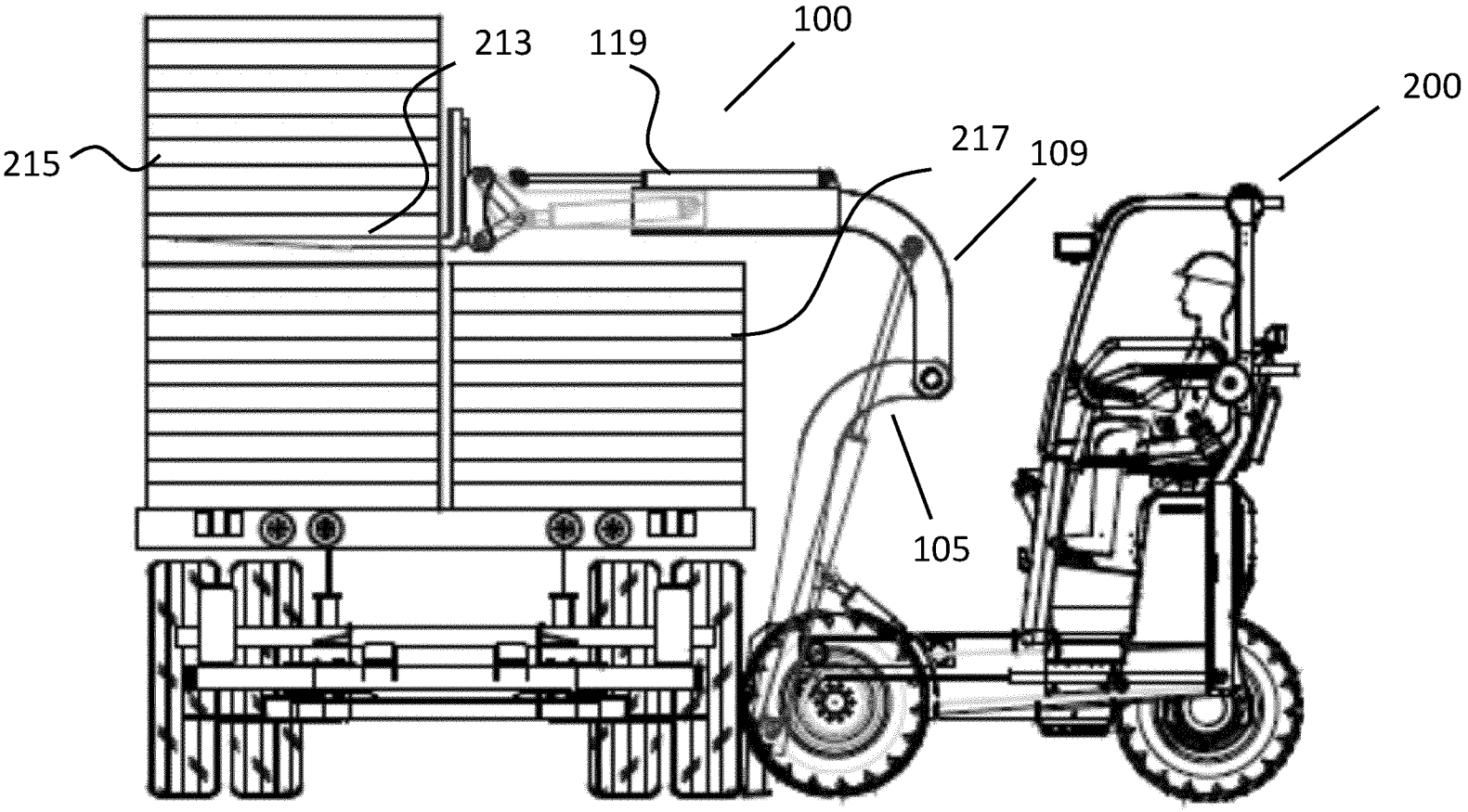

Referring to FIG. 6, the truck mounted forklift is shown engaging a top far side load 215. The telescopic ram has been extended and the tines 213 are underneath the load 215 and enable the load to be picked up. Importantly, due to the fact that a pantograph linkage is not required, it will be seen that the fork carriage will not impact against the roof (not shown) of the carrying vehicle. Furthermore, perhaps more importantly, it can be seen that the second link 109 will not impact against the lower near side load 217 and the lower near side load 217 will not have to be removed in order to allow access to the top far side load 215.

Figure 7:
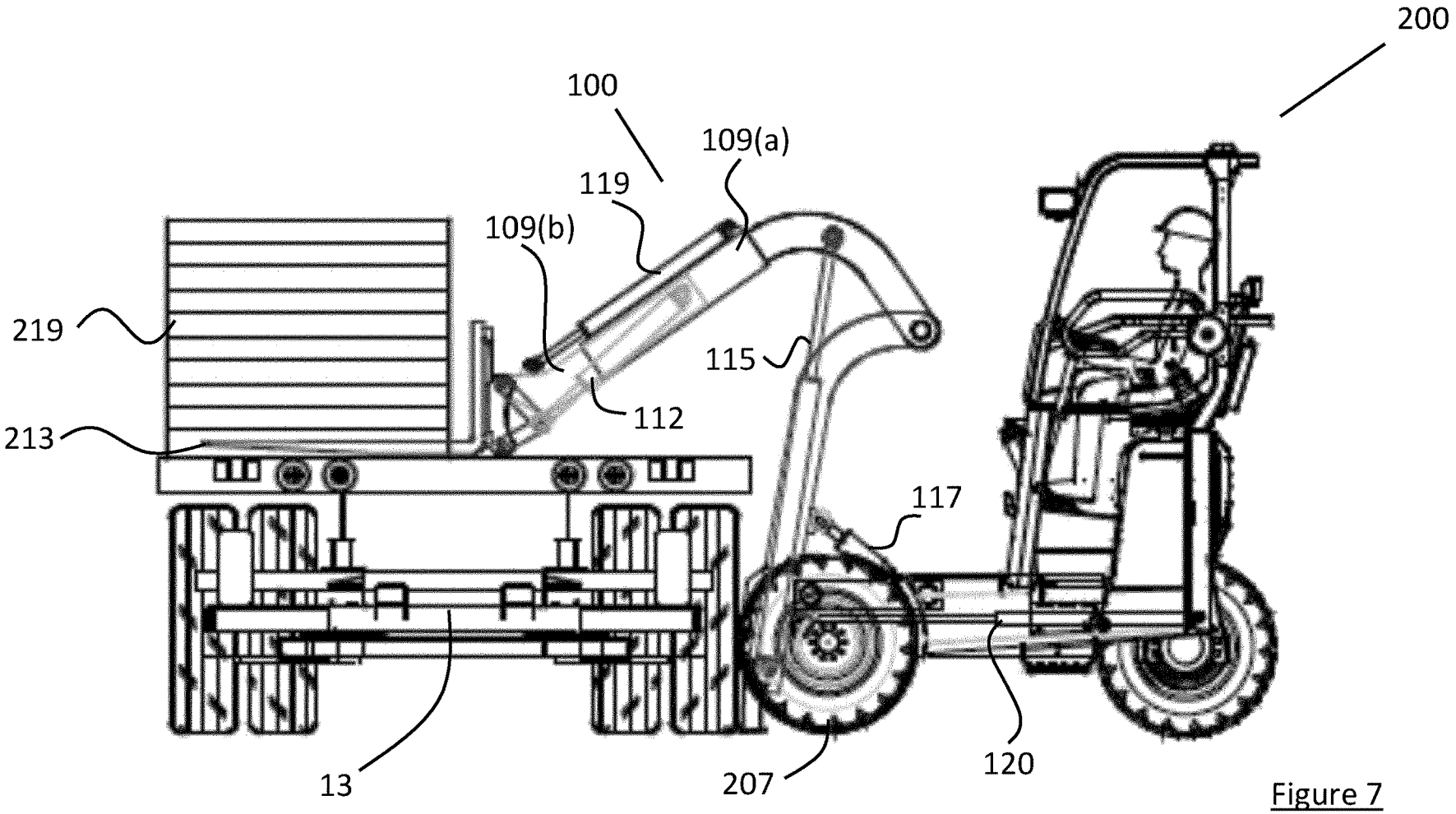

Referring to FIG. 7, there is shown a truck mounted forklift 200 engaging a bottom far side load 219. It will be noted that this is achieved without the front wheels 207 of the forklift being driven underneath the carrying vehicle 13. In this way, the manoeuvrability and operability of the forklift is improved. In order to achieve this, it is envisaged that there will be control circuitry to synchronize the operation of the tilt cylinder 112 and the link cylinders 115, 117. The control circuitry will be operable to ensure that as the links are raised or lowered, the tines 213 will remain in a fixed, substantially parallel relationship with the ground. Of course, the operator may provide an "offset" degree of forward or reverse tilt to the tines as required if picking up a load, dropping off a load, or carrying a load on the tines.

Figure 9:
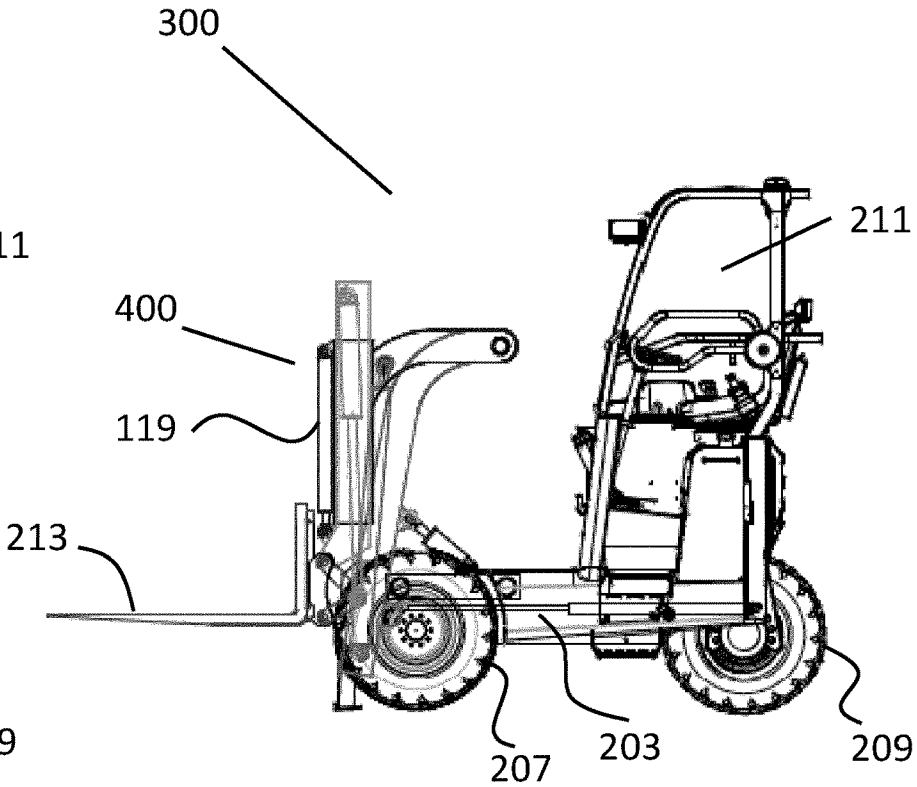
FIGS. 8 and 9 are side views of an alternative configuration of truck mounted forklift according to the invention.
Figure 8:
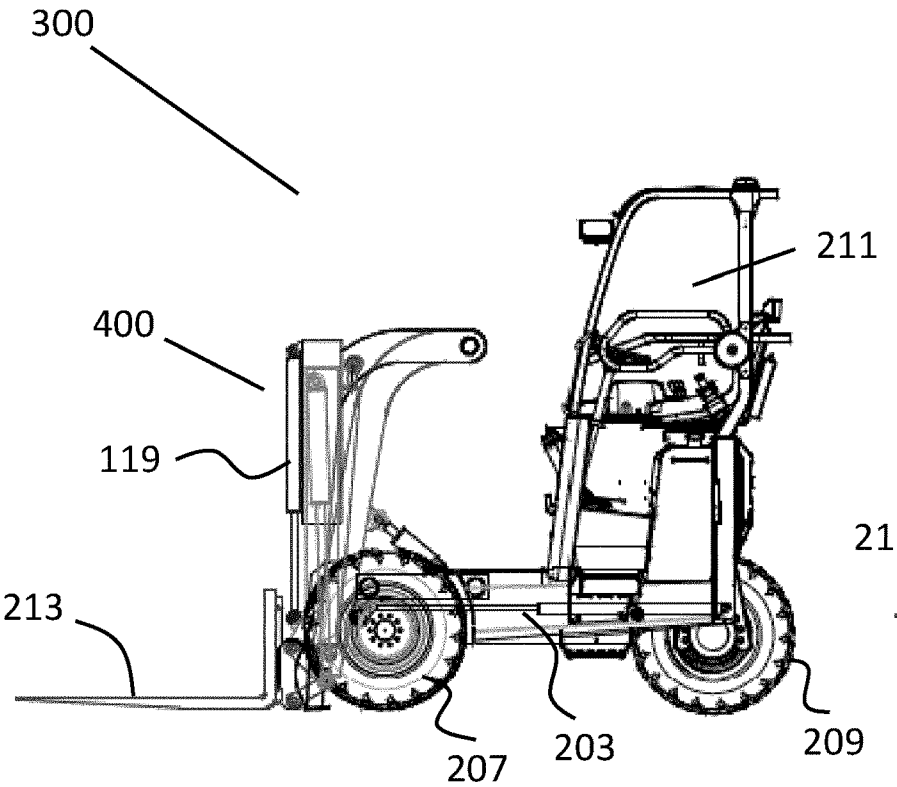

Referring now to FIGS. 8 and 9, there are shown side views of an alternative configuration of truck mounted forklift, indicated generally by the reference numeral 300, and lifting assembly, indicated generally by the reference numeral 400, where like parts have been given the same reference numeral as before. It can be seen from FIG. 8 that the telescoping cylinder 119 is configured to be at least partially extended in order to place the tines 213 substantially at ground level. When the telescoping cylinder 119 is retracted, the tines 213 will be raised off the ground to the position shown in FIG. 9 so that the tines may be used to engage tine pockets on a carrying vehicle for mounting the truck mounted forklift on the carrying vehicle.

In use, in order to mount the truck mounted forklift onto the carrying vehicle, lifting assembly is retracted and the tines 213 are raised off the ground to the position shown in FIG. 9. The forklift is then driven forwards to engage the tines 213 in tine pockets mounted on the chassis of the carrying vehicle (not shown). Once the tines 213 are engaged in the tine pockets, the tines are forced downwardly by the operation of the telescoping cylinder. As the tines are fixed in position in the tine pockets, this has the effect of raising the forklift off the ground. Advantageously, the forklift is raised and lowered to and from the carrying vehicle practically vertically rather than through an arcuate movement and this reduces the forces exerted on the tines, allowing lighter tines to be used, increasing the carrying capacity for goods on the carrying vehicle.

Various modifications could be made to the embodiments hereinbefore described without departing from the scope of the appended claims or the spirit of the invention. For example, more than one link cylinder 115, 117 could be provided for the second link and the first link respectively. Additionally, the telescoping cylinder 119 could be located internal the telescopic link sections however it could be external the telescopic link sections also, as illustrated in the drawings. In the embodiment shown, there are only two link sections 109(*a*), 109(*b*) in the telescopic link however more than two link sections in the telescopic link could be provided if desired.

In this specification the terms "comprise, comprises, comprised and comprising" and the terms "include, includes, included and including" are all deemed totally interchangeable and should be afforded the widest possible interpretation.

The invention is not limited to the embodiments hereinbefore described but may be varied in both construction and detail within the scope of the appended claims.

The invention claimed is:

1. A truck mounted forklift for mounting on the rear of a vehicle, the truck mounted forklift comprising a u-shaped chassis having a pair of forwardly projecting side bars bridged by a rear crossbar, a wheel adjacent the forward most end of each of the side bars and a rear wheel mounted on the rear cross bar, a driver's station mounted to one side of the chassis, a motive power unit mounted on the other side of the chassis and a linkage lifting assembly mounted on the chassis, the linkage lifting assembly comprising:

a carriage slidably mountable on the chassis, the carriage being slidable towards and away from the rear crossbar and means to move the carriage back and forth along the chassis; and a linkage, the linkage comprising:

an upright elongate first link connected at its proximal end to the carriage by a pivot joint;

an elongate second link connected at its proximal end to the distal end of the first link by a pivot joint, the elongate second link comprising a telescopic link having a plurality of link sections nested together;

a fork carriage connected to the distal end of the second link by a pivot joint;

a plurality of link cylinders for actuating the links;

a telescoping cylinder for lengthening and shortening the telescopic second link; and a tilt cylinder for actuating the fork carriage.

2. A truck mounted forklift as claimed in claim 1 in which the elongate second link is cranked intermediate its ends into a substantially L-shaped member such that with the linkage lifting assembly in a retracted configuration, the spine of the L-shaped member is directed substantially vertically and the arm of the L-shaped member is directed rearwardly from the uppermost part of the spine, and with the linkage lifting assembly in an extended configuration, the spine of the L-shaped member is directed forwardly and the arm of the L-shaped member is directed substantially vertically downwards from the rearward most part of the spine.

3. A truck mounted forklift as claimed in claim 1 in which the elongate second link is cranked intermediate its ends into a substantially L-shaped member such that the arm and the spine of the L-shaped members are substantially orthogonal with respect to each other.

4. A truck mounted forklift as claimed in claim 1 in which the elongate first link is cranked intermediate its ends into a substantially upside-down L-shaped member such that the spine of the L-shaped member is directed substantially vertically, and the arm of the L-shaped member is directed rearwardly from the uppermost part of the spine.

5. A truck mounted forklift as claimed in claim 1 in which the main link cylinder is connected at one of its ends to the second link and at the other of its ends to the carriage.

6. A truck mounted forklift as claimed in claim 1 in which the main link cylinder is connected at one of its ends to the second link and at the other of its ends to the first link.

7. A truck mounted forklift as claimed in claim 1 in which the secondary link cylinder is connected at one its ends to the first link and at the other of its ends to the carriage.

8. A truck mounted forklift as claimed in claim 1 in which the first link is raked backwards from the vertical on the forklift.

9. A truck mounted forklift as claimed in claim 1 in which the first link is raked backwards at an angle of the order of 5 to 15 degrees from the vertical on the forklift.

10. A truck mounted forklift as claimed in claim 1 in which the telescoping cylinder is located internal the second link.

11. A truck mounted forklift as claimed in claim 1 in which the telescoping cylinder is located external the second link.

12. A truck mounted forklift as claimed in claim 1 in which the tilt mechanism cylinder is located internal the second link.

* * * * *